US012607418B2

(12) United States Patent
Siemieńczuk

(10) Patent No.: US 12,607,418 B2
(45) Date of Patent: Apr. 21, 2026

(54) HEAT EXCHANGER AND ITS MANUFACTURING METHOD

(71) Applicant: AIC SPOLKA AKCYJNA, Gdynia (PL)

(72) Inventor: Tomasz Siemieńczuk, Gdynia (PL)

(73) Assignee: AIC SPOLKA AKCYJNA, Gdynia (PL)

( * ) Notice: Subject to any disclaimer, the term of this patent is extended or adjusted under 35 U.S.C. 154(b) by 130 days.

(21) Appl. No.: 18/732,568

(22) Filed: Jun. 3, 2024

(65) Prior Publication Data

US 2025/0283674 A1 Sep. 11, 2025

(30) Foreign Application Priority Data

Mar. 9, 2024 (PL) ..... 447972

(51) Int. Cl.

| | |
|---|---|
| ***F28F 3/00*** | (2006.01) |
| ***F28D 9/00*** | (2006.01) |
| *F28F 13/12* | (2006.01) |

(52) U.S. Cl.

CPC ..... *F28F 3/005* (2013.01); *F28D 9/005* (2013.01); *F28F 13/12* (2013.01); *F28F 2265/16* (2013.01)

(58) Field of Classification Search

CPC ..... F28D 9/005; F28F 3/005; F28F 2265/16; F28F 1/003

See application file for complete search history.

(56) References Cited

FOREIGN PATENT DOCUMENTS

| | | | | |
|---|---|---|---|---|
| EP | 3779345 | A1 | 2/2021 | |
| EP | 4102170 | A1 | 12/2022 | |
| WO | 2012148972 | A1 | 11/2012 | |
| WO | WO-2019176567 | A1 * | 9/2019 | ..... F28F 3/005 |
| WO | WO-2021229934 | A1 * | 11/2021 | ..... F28F 3/10 |
| WO | 2022015217 | A1 | 1/2022 | |

* cited by examiner

*Primary Examiner* — Eric S Ruppert

(74) *Attorney, Agent, or Firm* — Myers Wolin, LLC

(57) ABSTRACT

A heat exchanger comprising packages (A, B) which comprise turbulising elements (1) which turbulise a flow of a working fluid between the two walls (2, 2') inside the packages (A, B). Packages (A, B) are set together alternately to accommodate the working fluid flowing through them. Packages (A, B) are connected to each other via pass-through connectors (6) which are fitted, respectively, in the inlet openings (4, 5) and outlet openings (4', 5') for the working fluids. The connector (6) comprises an external portion (6*a*) and an internal portion (6*b*) which are connected to each other with a transverse wall (6*c*). The internal portion (6*b*) of the connector (6) is connected to the walls (2, 2') of the respective package (A, B) and closes the corresponding inlet/outlet opening (4, 4', 5, 5'), while the external portion (6*a*) of the connector (6) is connected to the neighbouring walls (2, 2') of the neighbouring packages (A, B) and connects the neighbouring areas of flow of the same working fluid. The heat exchanger can be manufactured by the diffusion bonding method.

9 Claims, 3 Drawing Sheets

HEAT EXCHANGER AND ITS MANUFACTURING METHOD

Figure 1:
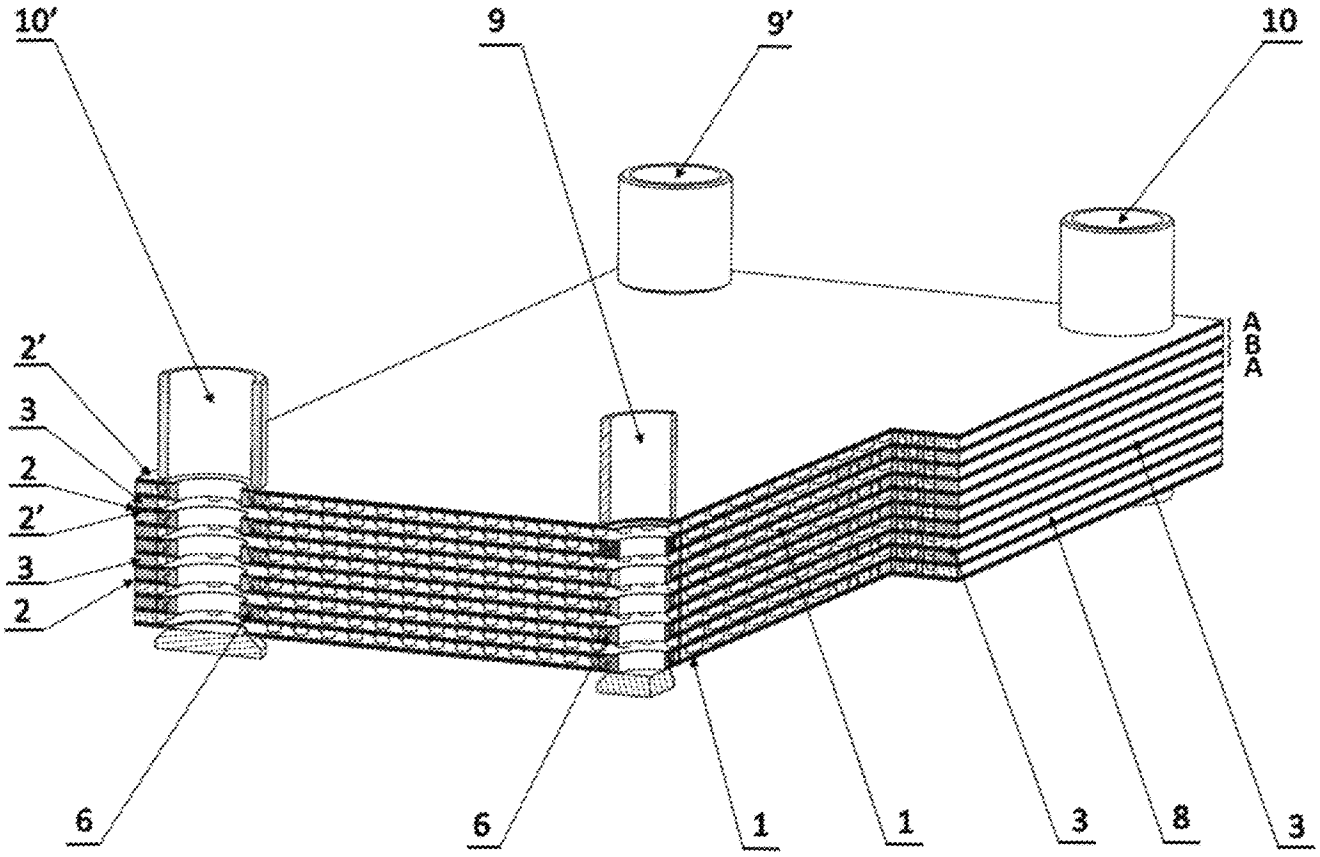

The present application is filed under USC 35 § 111(a) claiming priority to Polish Application P.447972, filed on Mar. 9, 2024, the content of each is incorporated by reference in its entirety for all purposes.

The invention concerns a heat exchanger incorporating two double walls between the areas of flow of the working fluids, and its manufacturing method.

The use of double walls between the areas of flow of the working fluids prevents mixing of the working fluids when the heat exchanger gets damaged and facilitates detection of a working fluid leakage.

Double walls should be arranged at a sufficient distance from each other so as to enable free flow of the leaking fluid towards the detection position, while placing them possibly close to each other is desirable in terms of ensuring sufficient effectiveness of heat exchange between the working fluids. Hence, various attempts have been taken to design double-walled heat exchanger taking into consideration these two requirements.

There many various solutions of plate double-walled heat exchangers known in the prior knowledge, the manufacturing of which is possible using the soldering method.

Known is application of the diffusion bonding method to manufacture heat exchangers required to offer higher mechanical resistance. However, the known heat exchangers manufactured by the diffusion bonding method do not feature double walls which would prevent the mixing of the working fluids, should a leak occur.

Known from patent document EP 3 779 345 A1 is a heat exchanger made by the diffusion bonding method and incorporating numerous plates with flow paths in the form of grooves for the working fluids, where the plates are positioned at a specific distance from each other which ensures strong connection between the plates which are stacked and diffusion bonded, and where the inlets and outlets for the working fluids are located on the shorter side end walls of the plate package, along the direction of the inflow/outflow of the working fluids, and where the walls end with the end plates featuring a collective working fluid inlet/outlet.

Known from patent document WO 2012/148972 A1 is a soldered heat exchanger which incorporates many pairs of heat transfer plates. Each pair of heat transfer plates forms a double-walled structure, incorporating two plates exchanging the heat, which are separated at least partially with a leakage discharge space. There is at least one discharge opening made in many pairs of the plates exchanging the heat, which goes through the leakage discharge spaces of multiple plate pairs so as to direct the leaking fluid from the leakage discharge spaces outside of the heat exchanger.

Known from patent document WO 2022/015217 A1 is a plate heat exchanger with double walls featuring ridges and grooves and ensuring contact points between the neighbouring elements of the heat exchanger. Each element of the heat exchanger incorporates at least two plates connected to each other, and formed between the plates of every single element of the heat exchanger are leakage ducts running across the ridges and groves, where the ducts are connected to each other and to the leakage outlet. The heat exchanger is made by the soldering method.

Known from patent document EP 4 102 170 A1 is a plate heat exchanger incorporating a stack of double-walled plate elements, where the elements comprise a first heat transfer plate and a second heat transfer plate. Each plate element comprises a central portion provided with surface patterns which form flow paths for the working fluid. Plate elements feature inlet/outlet openings with open and closed projections formed in opposite directions so that the closed and open projections define together the first leak cavity, and where the open projection is adapted to allow the fluid to pass between the respective opening and the respective flow path, while the closed projection is adapted to close the flow and seal the respective opening from the respective flow path.

There is a problem related to the double-walled plate heat exchangers known from the prior art: their manufacturing is difficult and complicated, and they do not provide sufficient protection against potential leakage of the working fluid in the areas of working fluid inlets and outlets.

The purpose of this invention is to overcome the above problems and ensure a reliable and efficient heat exchanger of high durability parameters, featuring double walls between the areas where the working fluids flow and in the area of inlet and outlet connections for the working fluids, where the exchanger can be manufactured by the diffusion bonding method.

According to the present invention, a heat exchanger comprising a profiled heat transfer surface in areas of flow of working fluids, double walls between the areas where the working fluids flow, as well as inlet and outlet ducts for the working fluids is characterised in that it comprises packages which comprise elements turbulising the flow of the working fluid between two walls inside the packages, where the said walls of each package are connected to each other by a side wall along the perimeter of the package, each package features inlet and outlet openings for the working fluids, and the packages are set together alternately to accommodate the working fluid flowing through the said packages, and where the packages and connected to each other via pass-through connectors which are fitted, respectively, in the inlet and outlet openings for the working fluids, and where the said connector comprises an external portion and an internal portion, and where the internal portion of the connector is connected to the walls of the respective package and closes the respective inlet/outlet opening, while the external portion of the connector is connected to the neighbouring walls of the neighbouring packages and connects the neighbouring areas of flow of the same working fluid so that formed between the neighbouring packages is a first area for the discharge of the leaking working fluid, and between the internal portion and the external portion of the connector there is a second area for the discharge of the leaking working fluid, connected to the first areas for the discharge of the leaking working fluid, between the neighbouring packages.

Preferably, the side wall of the packages takes the form of a frame.

Preferably, the external portion of the connector and/or the internal portion of the connector takes the form of a ring.

Preferably, the external surface of the side wall of the internal portion of the connector is given a barrel-like shape.

Preferably, the external portion of the connector is connected to the internal portion of the connector with a transverse wall so that the second area between the external portion and the internal portion is divided into two second areas for the discharge of the leaking working fluid, where the second areas are connected, respectively, with the first areas for the discharge of the leaking working fluid, between the neighbouring packages.

Preferably, the transverse wall of the connector is positioned at an angle with respect to the external portion and the internal portion of the connector.

Preferably, the external portion of the connector features at last one positioning undercut and/or preferably the internal portion of the connector features at least one positioning undercut.

A method of manufacturing a heat exchanger according to the present invention consists in setting together package walls, turbulising elements, side package walls, and connectors, and then all components are subject to the process of connection by diffusion bonding.

The invention meets the envisaged purposes. The structure of the connectors described above enables exclusive use of the diffusion bonding method in the process of manufacturing the heat exchanger. The diffusion bonding method guarantees obtaining high durability parameters, resistance to high pressure of the working fluids included. The use of connectors according to the invention ensures discharge of the leaking working fluid from the area around the working fluid inlet/outlet openings into the leakage area in between the packages and discharging it outside.

Figure 2:
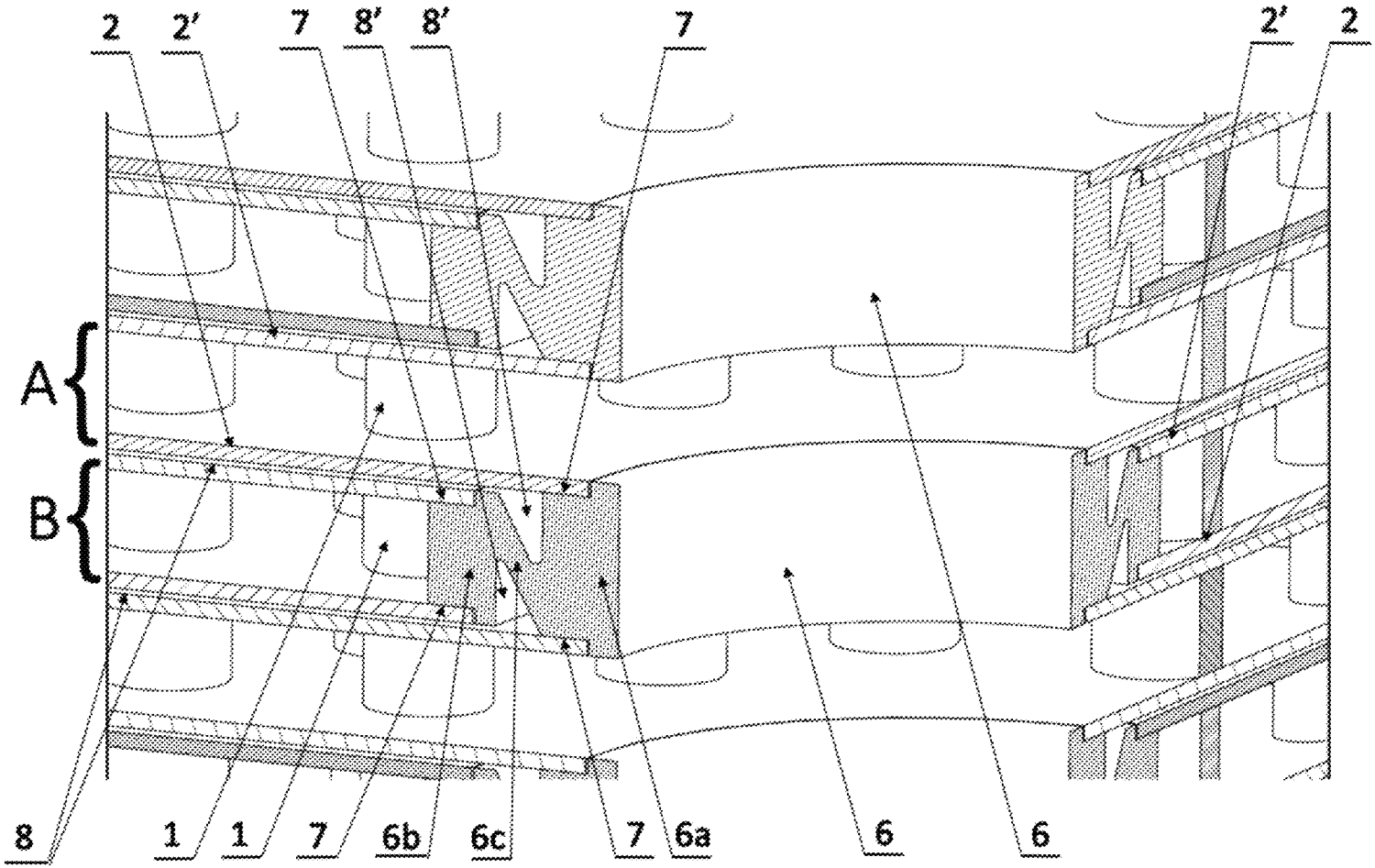
Figure 3:
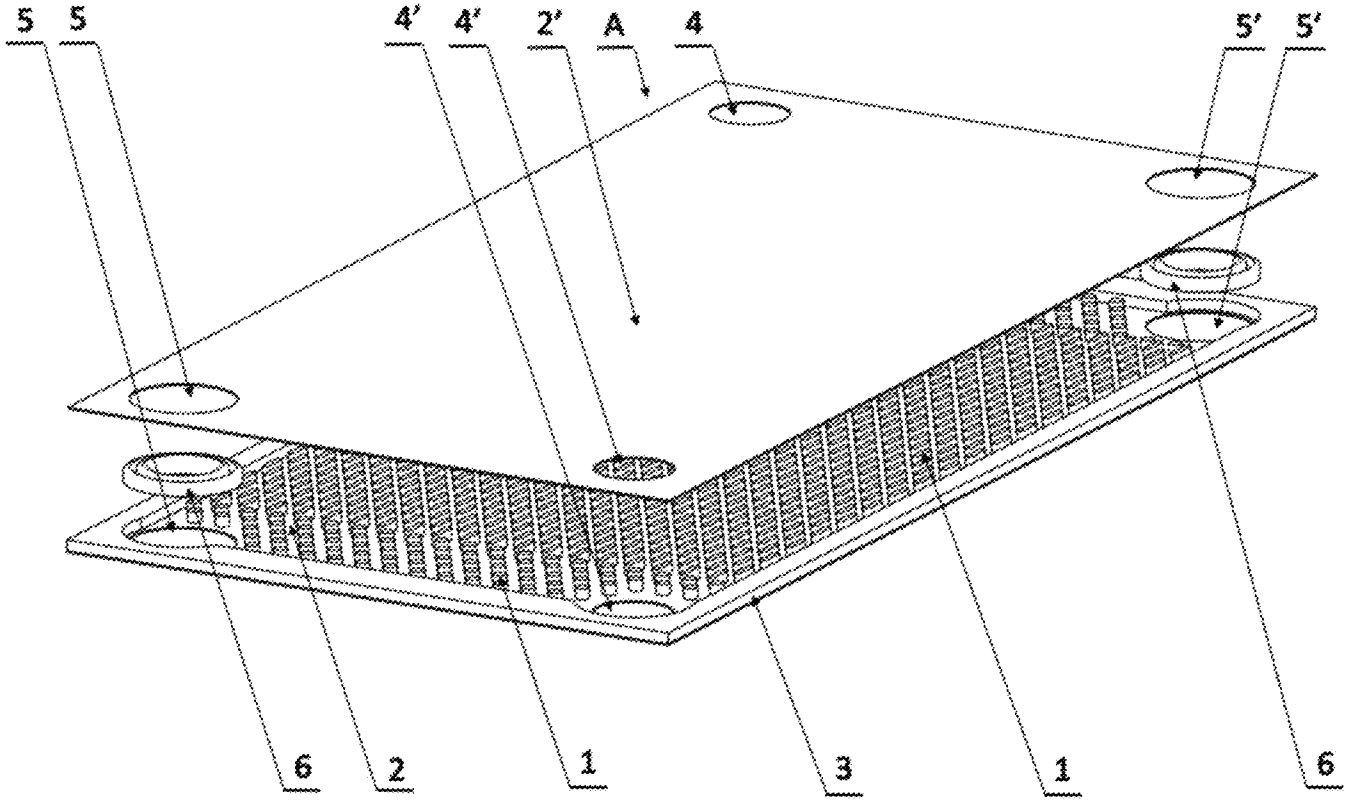

The invention is shown in its embodiments on a drawing, where:

FIG. 1 shows the heat exchanger in partial spatial view and partial cross section;

FIG. 2 presents mutual configuration of the package walls and connectors, in enlarged view;

FIG. 3 depicts package elements, in spatial view.

An exemplary heat exchanger comprises packages A and packages B with a turbulising structure 1 to turbulise a flow of a working fluid, for example incorporating ribs, bulges, or corrugations etc. on the surface, where the structure is placed inside the packages A, B, between two plate walls 2, 2' connected permanently to the said turbulising structure 1 and to each other with its side wall 3, for example taking the form of a frame, along the perimeter of the package. The turbulising structure 1 can also take the shape of surface patterns on the walls 2, 2', forming paths for the flow of the working fluid (not shown on the drawing). Each package A, B features inlet openings 4, 5 and outlet openings 4', 5' for the working fluids (the first working fluid flowing through packages A, and the second working fluid flowing through packages B), as shown in FIG. 1 and FIG. 3. Packages A, B are set together alternately to accommodate the working fluid flowing through them, i.e. package B is placed on top of package A, and another package A is placed on top of package B, and so on, as shown in FIG. 1.

Formed between the neighbouring packages A, B is the first area 8 for the discharged of the leaking working fluid, as show in FIG. 1 and FIG. 2. The first working fluid flows through packages A, and the second working fluid flows through packages B, in countercurrent with respect to the flow direction of the first working fluid through packages A. Packages A, B are connected to each other with pass-through connectors 6, for example in the shape of rings, for example given the N letter shape in cross section (as shown in FIG. 2). The connectors 6 are fitted, as appropriate, in the inlet openings 4, 5 and outlet openings 4', 5' for the working fluids. The said connector 6 incorporates the external portion 6*a* and the internal portion 6*b*, where these portions are located at a distance from each other and are connected to each other with the transverse wall 6*c* positioned at an angle with respect to the said portions 6*a*, 6*b*, so that the area between the said portions 6*a*, 6*b* is divided into two second areas 8' for the discharge of the leaking working fluid, as shown in FIG. 2. The external surface of the side wall of the internal portion 6*b* of the connector 6 on the side of the turbulising elements 1 can preferably be given a barrel-like shape. In addition, the external portion 6*a* of the connector 6 features positioning undercuts 7 on both sides, on the front surfaces which contact the respective walls 2, 2' of the neighbouring packages A, B, and the internal portion 6*b* of the connector 6 also features positioning undercuts 7 on both sides of the front surfaces which contact the walls 2, 2' of the respective package A, B, where the undercuts ensure stable alignment of the walls 2, 2' of packages A, B and connectors 6 for the purposes of the diffusion bonding process (as shown in FIG. 2).

For example, the connectors 6 are fitted in packages A in the inlet opening 5 and the outlet opening 5' designed for the second working fluid flowing through packages B. The internal portion 6*b* of the connector 6 is positioned inside package A in between its walls 2, 2' and is connected to the walls 2, 2', closing the inlet opening 5 and the respective outlet opening 5' for the second working fluid which flows through packages B, and the external portion 6*a* of the connectors 6 is connected to the neighbouring wall 2 of the neighbouring package B on the one end, and to the neighbouring side wall 2' of the second neighbouring package B on the other end, thus connecting the neighbouring areas where the second working fluid flows through packages B, where the height of the external portion 6*a* of the connectors 6 is chosen so that formed between the neighbouring packages A, B is the first area 8 for the discharge of the leaking working fluid. The second areas 8' for the discharge of the leaking working fluid are connected to the respective first areas 8 for the discharge of the leaking working fluid, on both sides of the package A, as shown in FIG. 2. The connectors 6 form inlet ducts 9 and outlet ducts 9' for the first working fluid flowing through packages A, as shown in FIG. 1. On the other hand, in packages B the connectors 6 are fitted in the inlet opening 4 and the outlet opening 4' designed for the first working fluid which flows through packages A. The internal portion 6*b* of the connector 6 is located inside package B, in between its walls 2, 2', and is connected to the walls 2, 2', closing the inlet opening 4 and, respectively, the outlet opening 4' for the first working fluid flowing through packages A, while the external portion 6*a* of the connectors 6 is connected to the neighbouring wall 2 of the neighbouring package A on the one end, and on the other end to the neighbouring wall 2' of the second neighbouring package A, connecting the neighbouring areas for the flow of the first working fluid through flowing packages A, and where formed between the neighbouring packages A, B is the first area 8 for the discharge of the leaking working fluid. The second areas 8' for the discharge of the leaking working fluid are connected to the respective first areas 8 for the discharge of the leaking working fluid, on both sides of package B, as shown in FIG. 2. The connectors 6 form inlet ducts 10 and outlet ducts 10' for the second working fluid which flows through packages B, as shown in FIG. 1. As presented in FIG. 1 and FIG. 2, such positioning and connection between the connectors 6 and plates 2, 2' of the packages A, B, results in forming a double wall in between the areas where the working fluids flow, and a double wall around the inlet openings 4, 5 and outlet openings 4', 5' for the working fluids, which enables discharging the leaking working fluid outside, and identify the leakage point.

The structure of the heat exchanger according to the invention, described in its embodiment, enables use of the diffusion bonding method to manufacture the heat exchanger without the need to reach for any other methods. All elements making up the heat exchanger, as described above, i.e. the walls 2, 2' of the packages A, B, the turbulising elements 1, side walls 3 of packages A, B, and connectors 6 are set together and then subject to the process of connecting them by diffusion bonding.

LIST OF NUMERICAL REFERENCES

A—package with a structure turbulising the flow of the working fluid
B—package with a structure turbulising the flow of the working fluid
1—elements turbulising the flow of the working fluid
2—package wall
2'—package wall
3—side package wall
4—inlet opening for the first working fluid
4'—outlet opening for the first working fluid
5—inlet opening for the second working fluid
5'—outlet opening for the second working fluid
6—connector between the areas for the flow of the working fluid
6*a*—external portion of the connector
6*b*—internal portion of the connector
6*c*—transverse wall of the connector
7—positioning undercuts
8—first area for the discharge of the leaking working fluid
8'—second area for the discharge of the leaking working fluid
9—inlet duct for the first working fluid
9'—outlet duct for the first working fluid
10—inlet duct for the second working fluid
10'—outlet duct for the second working fluid

The invention claimed is:

1. A heat exchanger comprising turbulizers that turbulize a flow of working fluids, as well as inlet and outlet ducts for the working fluids, the heat exchanger comprising:

packages including the turbulizers that turbulize the flow of the working fluid between two walls inside the packages, wherein the walls of each package are connected to each other by a side wall along the perimeter of the package, each package features inlet openings and outlet openings for the working fluids, wherein the packages are set together alternately to accommodate the working fluid flowing through the packages, wherein the packages are connected to each other via pass-through connectors, where each pass-through connector is fitted, respectively, in the inlet openings and outlet openings for the working fluids, wherein each of the pass-through connectors comprises an external portion and an internal portion, and wherein the internal portion of each of the pass-through connectors is connected to the walls of the respective package and closes the corresponding inlet/outlet opening, while the external portion of each of the pass-through connectors is connected to the neighboring walls of the neighboring packages and connects the neighboring areas of flow of the same working fluid so that formed between the neighboring packages is a first area for the discharge of the leaking working fluid, and between the internal portion and the external portion of each of the pass-through connectors there is a second area for the discharge of the leaking working fluid, connected to the first areas for the discharge of the leaking working fluid, between the neighboring packages.

2. The heat exchanger according to claim 1, wherein the side wall of the packages takes the form of a frame.

3. The heat exchanger according to claim 1, wherein the external portion of each of the pass-through connectors and/or the internal portion of each of the pass-through connectors takes the form of a ring.

4. The heat exchanger according to claim 1, wherein the external surface of the side wall of the internal portion of each of the pass-through connectors is given barrel shaped.

5. The heat exchanger according to claim 1, wherein the external portion of each of the pass-through connectors is connected to the internal portion of each of the pass-through connectors with a transverse wall so that the second area between the external portion and the internal portion is divided into two second areas for the discharge of the leaking working fluid, where the second areas are connected, respectively, with the first areas for the discharge of the leaking working fluid, between the neighboring packages.

6. The heat exchanger according to claim 5, wherein the transverse wall of each of the pass-through connectors is positioned at an angle with respect to the external portion and the internal portion of each of the pass-through connectors.

7. The heat exchanger according to claim 1, wherein the external portion of each of the pass-through connectors features at last one positioning undercut.

8. The heat exchanger according to claim 1, wherein the internal portion of each of the pass-through connectors features at least one positioning undercut.

9. The heat exchanger according to claim 1, wherein the walls of the packages, the turbulizers placed between walls, the side walls located along the perimeter of the packages and the pass-through connectors connecting the packages are connected to each other by a diffusion bonding.

* * * * *